US005295448A

United States Patent [19]

Vickery

[11] Patent Number: 5,295,448

[45] Date of Patent: Mar. 22, 1994

[54] ORGANIC COMPOUND INCINERATOR

[75] Inventor: Earl C. Vickery, San Jose, Calif.

[73] Assignee: On-Demand Environmental Systems, Inc., San Jose, Calif.

[21] Appl. No.: 726,298

[22] Filed: Jul. 5, 1991

Related U.S. Application Data

[63] Continuation-in-part of Ser. No. 623,351, Dec. 7, 1990, abandoned.

[51] Int. Cl.[5] ..... F23G 7/06

[52] U.S. Cl. ..... 110/214; 110/184; 110/233; 110/235; 432/72

[58] Field of Search ..... 110/210, 233, 211, 235, 110/214, 345, 184; 432/72

[56] References Cited

U.S. PATENT DOCUMENTS

| | | | |
|---|---|---|---|
| 2,480,230 | 8/1949 | Elster . | |
| 2,743,529 | 5/1956 | Hayes | 432/72 |
| 3,261,008 | 7/1966 | Schreter et al. . | |
| 3,606,611 | 10/1968 | Wright . | |
| 3,741,134 | 6/1973 | Roberts et al. . | |
| 3,801,973 | 4/1974 | Grabiel et al. . | |
| 3,857,672 | 12/1974 | Reed et al. . | |
| 3,893,810 | 7/1975 | Lientz . | |
| 3,914,088 | 10/1975 | Huyck . | |
| 3,985,494 | 10/1976 | Childree | 431/5 |
| 3,993,449 | 11/1976 | Childs . | |
| 4,038,032 | 7/1977 | Brewer et al. . | |
| 4,123,220 | 10/1978 | Bond et al. . | |
| 4,147,502 | 4/1979 | Milton, Jr. | 432/72 |
| 4,149,453 | 4/1979 | Reed | 110/184 |
| 4,174,201 | 11/1979 | Straitz, III . | |
| 4,215,095 | 7/1980 | Harris et al. . | |
| 4,230,580 | 10/1980 | Dodson . | |
| 4,269,806 | 5/1981 | Yaguchi et al. . | |
| 4,276,063 | 6/1981 | Lackey et al. . | |
| 4,305,724 | 12/1981 | Micko . | |
| 4,444,735 | 4/1984 | Birmingham et al. . | |
| 4,454,494 | 6/1984 | Williams et al. . | |
| 4,464,653 | 8/1984 | Winner . | |
| 4,466,359 | 8/1984 | Weber et al. . | |
| 4,499,945 | 2/1985 | Hill et al. . | |
| 4,515,089 | 5/1985 | Ehrlichmann | 110/235 |
| 4,517,161 | 5/1985 | Gravina et al. . | |
| 4,519,999 | 5/1985 | Coleman et al. . | |
| 4,610,625 | 9/1986 | Bunn . | |
| 4,661,056 | 4/1987 | Vickery et al. . | |
| 4,815,398 | 3/1989 | Keating, II et al. | 110/233 |
| 5,002,484 | 3/1991 | Lofton et al. | 432/222 |
| 5,007,404 | 4/1991 | Hall et al. | 110/214 |

FOREIGN PATENT DOCUMENTS

| | | |
|---|---|---|
| 488688 | 5/1971 | Japan . |
| 5021994 | 6/1973 | Japan . |

*Primary Examiner*—Henry C. Yuen
*Attorney, Agent, or Firm*—Robert O. Guillot

[57] ABSTRACT

A volatile organic compound (VOC) incinerator that is designed for installation in the exhaust airstream of VOC generating equipment. The incinerator includes an intake end, combustion chamber and an exhaust end. A flame baffle is disposed within the combustion zone to cause mixing of the VOC plus hot air mixture to increase efficiency and reduce fuel requirements. A temperature sensor is disposed within the combustion zone of the combustion chamber of the incinerator to monitor the combustion temperature to provide temperature signals to a controller. An air flow rate sensor is engaged in the intake end of the incinerator to provide air flow rate signals to the controller. The controller regulates the quantity of fuel injected into the VOC plus air mixture based upon the air flow rate signals and the temperature signals. A VOC detector is disposed in the intake end of the incinerator to provide a signal that turns the unit on or off depending upon the presence or absence of VOC's in the airstream.

24 Claims, 8 Drawing Sheets

ORGANIC COMPOUND INCINERATOR

RELATED PATENT APPLICATION

This patent application is a continuation-in-part patent application based upon U.S. patent application Ser. No. 07/623,351, filed Dec. 7, 1990, entitled "IMPROVED ORGANIC COMPOUND INCINERATOR", invented by Earl C. Vickery, the inventor named in the present application.

BACKGROUND OF THE INVENTION

1. Field of the Invention

The present invention relates generally to devices and methods for incinerating industrial waste compounds, and more particularly to devices that are installable within the exhaust ducting of industrial processing equipment to incinerate organic industrial waste products and having a flame baffle disposed within the combustion zone to aid in the incineration process.

2. Brief Description of the Prior Art

Chemical processes used in the manufacture of microelectronic devices as well as other industries emit waste streams of materials known as volatile organic compounds (VOCs) usually in low concentrations of an exhaust air stream. Such concentrations can be in the order of a few parts per billion to several percent. The majority of the waste streams however, contain VOC waste products that are in concentrations of fifty to 1000 parts per million. Such waste streams account for the release to the environment of thousands of tons per year on a global scale. The detrimental effects of these releases have become better understood in recent year and efforts to reduce them through better processing to minimize both the use and amount of VOCs released have become important. Even with these efforts, unacceptably high levels of VOCs are released on a daily basis. Equipment known as abatement devices are used to adsorb/absorb, react, recover, and convert the VOC wastes to prevent their release. Recent studies in states such as California show that waste streams containing low concentrations of VOCs can be very expensive to process. Often a limiting factor for regulatory agencies to require the use of abatement devices is the extremely high cost of converting each pound of VOC waste. Another is the production of reaction products which are as undesirable to release as the VOC being processed. One example of the latter is the production of oxides of nitrogen when flame is used to incinerate or otherwise convert VOC wastes. The South Coast Air Quality Management District located in Southern California currently limits the creation of no more than two pounds of oxides of nitrogen for each ten pounds of VOC destroyed.

Unlike U.S. patent application Ser. No. 07/438,678 filed in Nov. 17, 1989 by myself and Jay R. Walker, the present invention does not attempt to measure or quantify the VOC's contained in a waste air stream. That technique of my prior application requires that the VOC concentration be high enough to have some positive fuel value or contain a VOC waste in sufficient concentrations as to require additional fuel to induce pyrolytic decomposition. Such concentrations are in the range of 0.1-1% before they become significant. Waste streams found in industry usually contain 0.001-0.1% thus severely limiting the application of the prior device. A national sampling of the electronic, chemical, and pharmaceutical industries showed that waste streams containing VOC concentrations of 0.1% or greater were the exception to the rule. Additionally, the nitrogen oxides produced by that prior device were in the order of several hundred parts per million, an unexceptionably high concentration. The present invention is designed to control the conditions of the reaction zone to allow greater than 90% conversion of VOC's and generation of nitrogen oxides equal to or less than 0.000025%. Using the criteria of 20% nitrogen oxide generation described earlier, waste streams containing less than 0.000125% of VOC's can be processed with this new device and still meet the most stringent existing regulations. A device patented by Brewer et al. in 1977, described in U.S. Pat. No. 4,038,032, uses the temperature measured at the output port of the combustion chamber to control the fuel flow to the burner. Also Brewers device is designed to operate in a continuous mode and as such, the output temperature can vary as a function of system heating and cooling of air passing over the outside of the combustion tube. This variation has been measured to be in excess of forty degrees centigrade which interferes with proper monitoring of the reaction zone temperature.

Further prior art known to the applicant includes U.S. Pat. No. 4,661,056, issued Apr. 28, 1987 to Earl Vickery (one of the inventors of the present application) and Mark Yates. Other relevant prior art includes U.S. Pat. No. 4,444,735, issued Apr. 24, 1984 to Birmingham et al.; U.S. Pat. No. 4,038,032, issued Jul. 26, 1977 to Brewer et al.; U.S. Pat. No. 4,305,724, issued Dec. 15, 1981 to Micko; U.S. Pat. No. 4,464,653, issued Aug. 7, 1984 to Winner; U.S. Pat. No. 4,123,220, issued Oct. 31, 1978 to Bond et al.; U.S. Pat. No. 3,993,449, issued Nov. 23, 1976 to Childs; and U.S. Pat. No. 3,893,810, issued Jul. 8, 1985 to Lientz.

SUMMARY OF THE INVENTION

It is an object of the present invention to provide an improved VOC incinerator that efficiently processes small concentrations of waste products without the creation of excessive quantities nitrogen oxides.

It is another object of the present invention to provide an improved VOC incinerator which utilizes a temperature sensor disposed within the combustion zone of the incinerator to control fuel input to the device.

It is a further object of the present invention to provide an improved VOC incinerator having an enlarged combustion chamber, whereby the possibility of flashback is eliminated, and the residence time for completion of reactions is increased.

It is yet another object of the present invention to provide an improved VOC incinerator that is activated by a VOC detector wherein the quantity of incinerating fuel is controlled by an air velocity sensor and a combustion zone temperature sensor.

It is yet a further object of the present invention to provide an improved VOC incinerator that includes a flame baffle to improve the efficiency of the device.

It is still another object of the present invention to provide an improved VOC incinerator having a flame baffle disposed within the combustion zone of the device to facilitate mixing of VOC's with the combustion flame and hot air, to improve the efficiency of the device and to reduce the quantity of fuel necessary to achieve desired VOC conversion.

It is still a further object of the present invention to provide an improved VOC incinerator having an improved fuel injector disposed within the intake end of the device to facilitate the mixing of fuel with the incoming air plus VOC mixture, whereby reduced fuel consumption is achieved.

It is yet another object of the present invention to provide an improved VOC incinerator that is easily constructed and which operates efficiently.

The improved VOC incinerator of the present invention includes an incineration chamber that is installed in the waste exhaust ducting of industrial processing equipment. An exhaust air velocity sensor is utilized to determine the flow rate of exhaust air emanating from the industrial equipment through the incinerator, and the quantity of incineration fuel is initially determined thereby. A VOC detector is disposed in the duct leading to the incinerator to activate the incinerator upon the detection of VOC's in the exhaust air. A fuel injection means is disposed in the throat of the incinerator, and an enlarged combustion chamber is disposed immediately downstream from the fuel injection means, such that the expanding gases of the incinerated exhaust air can expand into the combustion chamber without causing flashback down the throat of the incinerator. An improved fuel injection means includes a plurality of concentrically disposed ring-shaped fuel injection rods which serve to efficiently inject fuel into the incoming air plus VOC mixture. In the preferred embodiment a flame baffle is disposed within the combustion chamber proximate the combustion zone. The baffle is shaped and disposed to increase the mixing of VOC's with the flame and heated air within the combustion zone to improve the efficiency of the VOC conversion and to reduce the quantity of fuel necessary to produce efficient VOC conversion. A heat detection means is disposed within the combustion zone to detect the combustion temperature. Signals from the combustion zone heat detection means are utilized to further control the quantity of fuel that is injected into the device, such that the combustion zone temperature is maintained within desired predetermined limits. Control of the combustion zone temperature allows for the controlled reduction in the quantities of nitrogen oxides that are produced in the incineration process. Following incineration, the incinerated waste gases are exhausted through the exhaust duct of the industrial equipment to the ambient.

It is an advantage of the present invention that it provides a improved VOC incinerator that efficiently processes small concentrations of waste products without the creation of excessive quantities nitrogen oxides.

It is another advantage of the present invention that it provides an improved VOC incinerator which utilizes a temperature sensor disposed within the combustion zone of the incinerator to control fuel input to the device.

It is a further advantage of the present invention that it provides an improved VOC incinerator having an enlarged combustion chamber, whereby the possibility of flashback is eliminated, and the residence time for completion of reactions is increased.

It is yet another advantage of the present invention that it provides an improved VOC incinerator that is activated by a VOC detector wherein the quantity of incinerating fuel is controlled by an air velocity sensor and a combustion zone temperature sensor.

It is yet a further advantage of the present invention that it provides an improved VOC incinerator that includes a flame baffle to improve the efficiency of the device.

It is still another advantage of the present invention that it provides an improved VOC incinerator having a flame baffle disposed within the combustion zone of the device to facilitate mixing of VOC's with the combustion flame and hot air, to improve the efficiency of the device and to reduce the quantity of fuel necessary to achieve desired VOC conversion.

It is still a further advantage of the present invention that it provides an improved VOC incinerator having an improved fuel injector disposed within the intake end of the device to facilitate the mixing of fuel with the incoming air plus VOC mixture, whereby reduced fuel consumption is achieved.

It is yet another advantage of the present invention that it provides an improved VOC incinerator that is easily constructed and which operates efficiently.

The foregoing and other objects, features and advantages of the present invention will become apparent from the following detailed description of the preferred embodiments which make reference to the several figures of the drawing.

IN THE DRAWING

DETAILED DESCRIPTION OF THE PREFERRED EMBODIMENT

Figure 1:
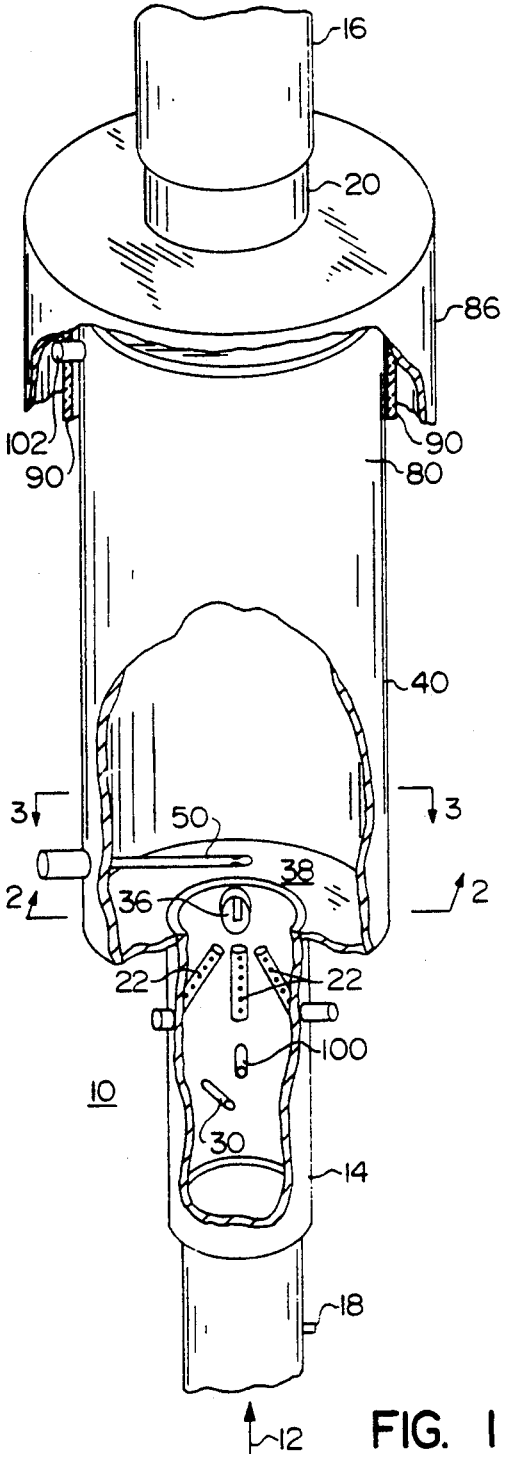
FIG. 1 is a perspective view of the volatile organic compound incinerator of the present invention, having cutaway portions.

The present invention is designed to process waste air streams containing very low concentrations of VOC waste products, as well as waste air streams containing VOC concentrations approaching their lower explosive limit (LEL).

As depicted in FIGS. 1-4, an air stream 12 which can contain a VOC material to be processed enters the intake end 14 of the device 10 by means of an air draw 16 connected to the exhaust end 20 of the device 10. A VOC detector 18 is disposed in the duct 19 that is engaged to the intake end 14 of the device to continuously sample the incoming air for the presence of VOC's. The VOC detector 18 is located upstream from the intake end 14 a sufficient distance to permit the unit to turn on following the detection of VOC's by the detector 18. A VOC component within the incoming air stream can be detected in several different ways. A preferred method to detect the presence of a VOC component in the air stream is by the use of a heated surface semiconductor device. Commercial gas detection instruments that also detect VOCs in very low concentrations use such devices. One such device is the model 8800 Combustible Gas Detector, manufactured by TIF Instruments, Inc. Alternatively, a track coater system, as is used in the manufacture of microelectronic devices to apply a thin coat of an organic material to substrates, can be used to detect VOC's. A signal from the VOC detector 18 is provided to inform the controller that VOC's are coming to the device 10 in the incoming air, and to activate the controller 26 to turn on the VOC processing unit. Thus, the fuel ignition and combustion operation of the device 10 are not continuous. Rather, fuel injection and combustion are triggered by the signal from the VOC detector 18. Likewise a signal from the VOC detector 18 that indicates that VOC's are no longer present in the incoming air is provided to the controller to determine when to shut off the VOC processing unit.

A fuel injection means such as the three porous fuel injection rods 22 adds fuel such as natural gas to the air stream in an amount calculated by the controller 26 to be at or above the lower flammable limit of the air stream without consideration of the VOC concentration. The quantity of fuel injected thus depends upon the flow rate of the intake waste air which is determined by measuring the air velocity with one of several well known techniques.

The preferred air velocity sensor technique used in this invention utilizes a Resistive Temperature Device (RTD) 30. A current passing through the RTD device 30 causes it to self heat and the velocity of the moving air stream cools the RTD and changes its resistance as a function of the air velocity. If the RTD device 30 is used in a balanced bridge circuit, as the resistance of the RTD changes, the voltage across the bridge circuit changes. An algorithm is utilized that describes the change of resistance to air velocity. A typical algorithm is, air velocity$=(-184.2+57.8)\times\log$(bridge offset voltage). The air velocity is then multiplied by the known cross-sectional area of the intake end 14 to determine the air flow rate. In the preferred embodiment a commercial air velocity sensing device is used, such as model FMA-604 sold by Omega Engineering, Inc.

In the preferred embodiment the fuel, such as natural gas, is metered by four needle valves 31*a*, 31*b*, 31*c*, 31*d*, each of which is engaged in series to a solenoid valve 32*a*, 32*b*, 32*c*, 32*d*, respectively. The four needle valve plus solenoid valve combination devices (such as 31*a* plus 32*a*) are engaged in a parallel relationship to a gas delivery line 34. Commercially available solenoid valves such as Honeywell Skinner Series 700 valves are suitable for this purpose. The preferred needle valves 31(*a–d*) are Parker C.P.I. stainless steel valves. The four needle valves 31(*a–d*) are adjusted to predetermined fuel flow rates depending upon the type of fuel and the fuel gas line pressure. In the embodiment described in the table below the needle valves are set to provide fuel gas flow rates of 31*a* at 3 CFM, 31*b* at 1 CFM, 31*c* at 2 CFM, and 31*d* at 3 CFM. The solenoid valves 32(*a–d*) are full on or full off devices. When the presence of a VOC component in the air stream is detected the proper combination of solenoid valves 32(*a–d*) are opened by signals from the computer controller depending upon the air flow rate that has been detected by the sensor 30. The table below illustrates the natural gas flow through various solenoid combinations for a four inch intake diameter processor operating on natural gas for intake air velocities in the range of 10 to 30 feet per second or approximately 50 to 160 CFM of air flow.

| Air Flow Volume V (CFM) | Solenoid Combination |
|---|---|
| $V < 60$ | 32a |
| $60 < V < 80$ | 32a + 32b |
| $80 < V < 100$ | 32a + 32c |
| $100 < V < 120$ | 32a + 32d |
| $120 < V < 140$ | 32a + 32b + 32d |
| $140 < V < 160$ | 32a + 32c + 32d |

The air-fuel mixture is ignited further into the device by means of an electrical spark, pilot flame, or other convenient ignition source 36. The burning mixture fuel-air +VOC proceeds into a combustion chamber area 40 whose diameter is preferably at least two times that of the intake section 14 containing the fuel injector 22 and ignition source 36 where some cooling of the burning gas mixture due to sudden volume expansion occurs. A temperature measuring device 50 such as a thermocouple is disposed in the combustion zone 38 of the combustion chamber 40 to measure the temperature in the combustion zone 38 and to relay combustion zone temperature information to the controller 26. The controller 26 compares this temperature to the proper temperature range that promotes efficient incineration of VOC's which minimizes the production of oxides of nitrogen. The preferred combustion zone temperature is approximately 900 degrees centigrade. If the detected temperature is different by a sufficient quantity (100 degrees centigrade in the preferred embodiment), the controller 26 adjusts the gas flow from the solenoids 32(*a–d*) to turn on the proper predetermined combination of solenoids, as set forth in the logic diagram of FIG. 5, to achieve the proper combustion zone temperature through adjustment of the fuel quantity.

When a VOC component is present in the air stream it will have a fuel value either acting as additional fuel for combustion or requiring additional fuel to offset an endothermic reaction. If the combustion zone temperature (as measured by detector 50) changes as a result of the VOC component, the controller 26 will select a different combination of solenoids 32(*a–d*) to maintain the preferred predetermined combustion zone temperature. If a temperature difference exceeds the maximum difference allowed in the controller computer program (200 degrees centigrade in the preferred embodiment), this is taken as an indication that an abnormal condition has occurred, and appropriate steps are taken.

It is therefore to be understood that when a VOC is detected in the incoming airstream that the controller 26 initially determines which solenoids 32(*a–d*) to open to achieve an appropriate fuel flow rate based upon the air flow rate signals from sensor 30. Thereafter, after ignition and stabilization of the temperature within the combustion zone, which takes approximately 40 seconds in the preferred embodiment, the controller commences to utilize temperature signals from the combustion zone temperature measuring device 50 to further control the operation of solenoids 32(*a–d*) to control the rate of fuel that is injected into the VOC plus air mixture, in order to maintain the proper combustion zone temperature.

An additional length 80 of the combustion chamber 40 remains above the combustion zone 38 to provide residence time for the chemical incineration reactions which have begun with combustion to continue. The upper end 82 of the combustion chamber 40 opens into an air space 84 that is pneumatically continuous with the air draw 16 connected to the exhaust end 20 of the device. The air space 84 is bounded by the walls of an outer heat containment shield 86. The heat containment shield 86 generally surrounds the walls of the combustion chamber 40 such that an air gap 88 exists between the walls of the heat shield 86 and the walls of the combustion chamber 40 The air gap 88 is therefore in pneumatic communication with the air space 84 and the air draw 16, such that the air draw 16 pulls ambient air through the air gap 88, into the air space 84 and through the exhaust end 20 of the unit 10. The ambient air moving through the air gap 88 thus serves to cool the heat radiated by the walls of the combustion chamber 40.

In the preferred embodiment, a layer of insulation 90 is engaged around the walls of the combustion chamber 40 to promote proper combustion temperatures within the combustion chamber 40 and to decrease radiated heat to the walls of the heat shield 86. An air gap 91 of approximately one-half inch may be formed between the insulation 90 and the walls of the chamber 40 to control overheating of the walls. Likewise, insulation material 92 is disposed at the upper end of the shield 86 and surrounding the exhaust end 20, to reduce heat radiation from the unit 10. As the reaction products leave the reaction chamber 40, they are mixed with ambient air in air space 84 to vent any gas leaks that might occur and cool the sensor wiring. This mixing of the hot exhaust gases with the relatively cool vent air reduces the exit temperature of the air mixture at the exhaust end 20. In an augmented device, the exhaust gases can then be passed through a heat exchanger to allow the heat of the reactor to be used as a source of heating for other requirements or be used to preheat the incoming air stream to reduce the total fuel requirements.

Additional thermocouples 100 and 102 are placed in the intake 14 and exhaust 20 ends respectively of the VOC processor 10 to provide the controller 26 with additional temperature information of inlet and outlet temperatures, to be used as safety devices. If a flashback should occur, as an example, the inlet temperature would rise rapidly, and the signal from thermocouple 100 to the controller 26 would cause the controller 26 to take the necessary steps to shut down the processor by closing all of the solenoid valves 32(*a–d*) and deactivating the ignition device 36, until the problem has been remedied. Likewise, a high or low reading from the exhaust temperature thermocouple 102 to the controller 26 would signal improper operation. The preferred high and low temperature range at thermocouple 102 is 1000 degrees centigrade to 700 degrees centigrade respectively.

Several volatile organic compounds were quantified with a gas chromatograph, Model 200, manufactured by Microsensor Technology Incorporated as they entered and left the VOC processing unit. Among the compounds tested were acetone, trichloroethane, isopropyl alcohol, and dichloromethane. All compounds were destroyed with an efficiency of 95% or greater. By operating the combustion zone at approximately 900 degrees centigrade, excellent VOC destruction and significantly reduced levels of oxides of nitrogen resulted.

The present invention preferably makes use of the computers ability to be programmed to determine the reaction zone temperature by means of averaging many temperature readings in real time. An average of twenty-five or more temperature readings is a practical number for a meaningful reaction zone temperature if averaging is necessary.

Figure 6:
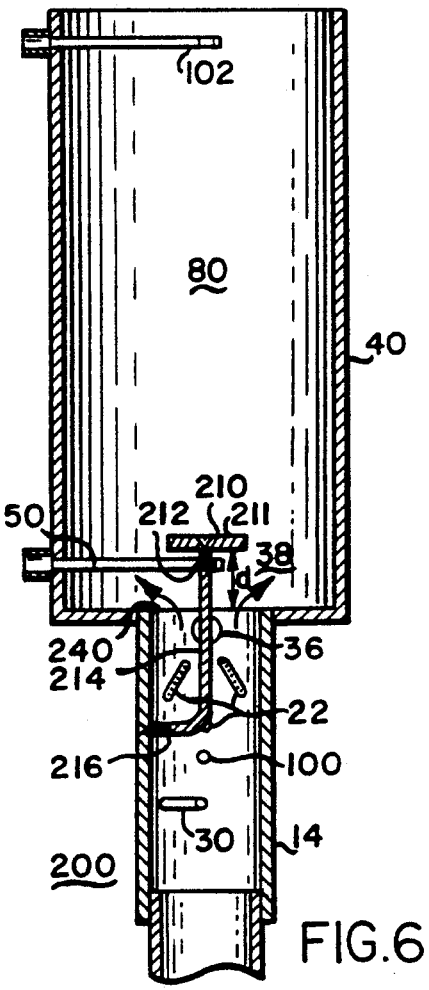
FIG. 6 is a cross-sectional view of the combustion chamber portion of the present invention, as depicted in FIG. 2, further including a preferred embodiment of a flame baffle disposed in the combustion zone of the device.

An improved preferred embodiment 200 of the present invention is depicted in FIG. 6. As will be understood by a comparison of FIG. 6 with FIG. 2, FIG. 6 depicts only the combustion chamber 40 portion of the device 10; it being understood that the remaining components depicted in FIG. 2 are necessarily a part of the embodiment 200 and that the remaining components have been omitted from FIG. 6 for the sake of clarity and simplicity of understanding.

Figure 2:
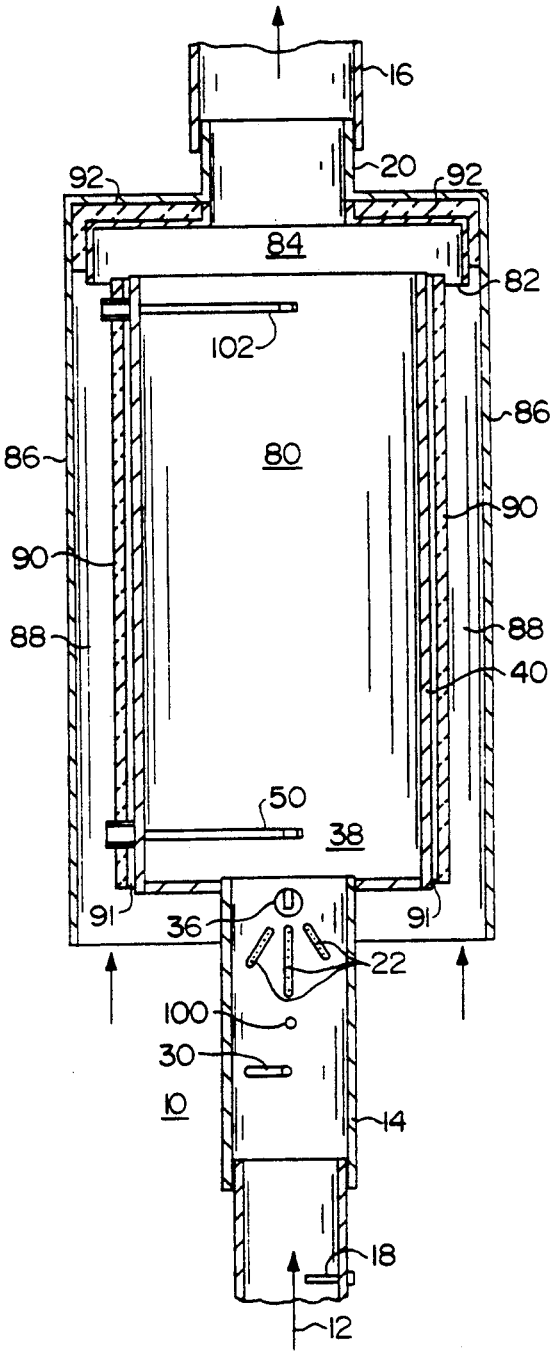
FIG. 2 is a cross-sectional view of the present invention, taken along lines 2—2 of FIG. 1.
Figure 3:
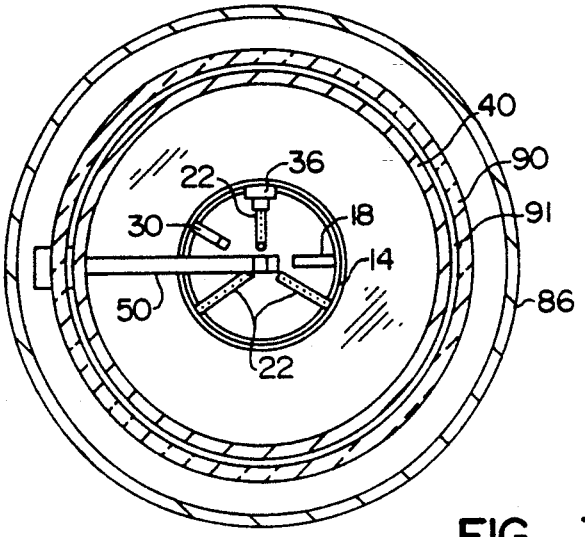
FIG. 3 is a cross-sectional view of the present invention, taken along lines 3—3 of FIG. 1.
Figure 4:
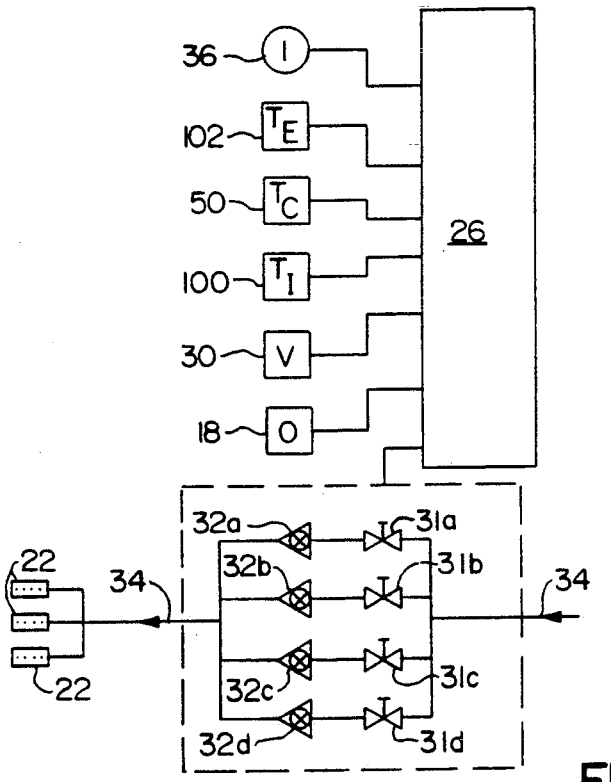
FIG. 4 is a schematic control diagram of the present invention.
Figure 5A:
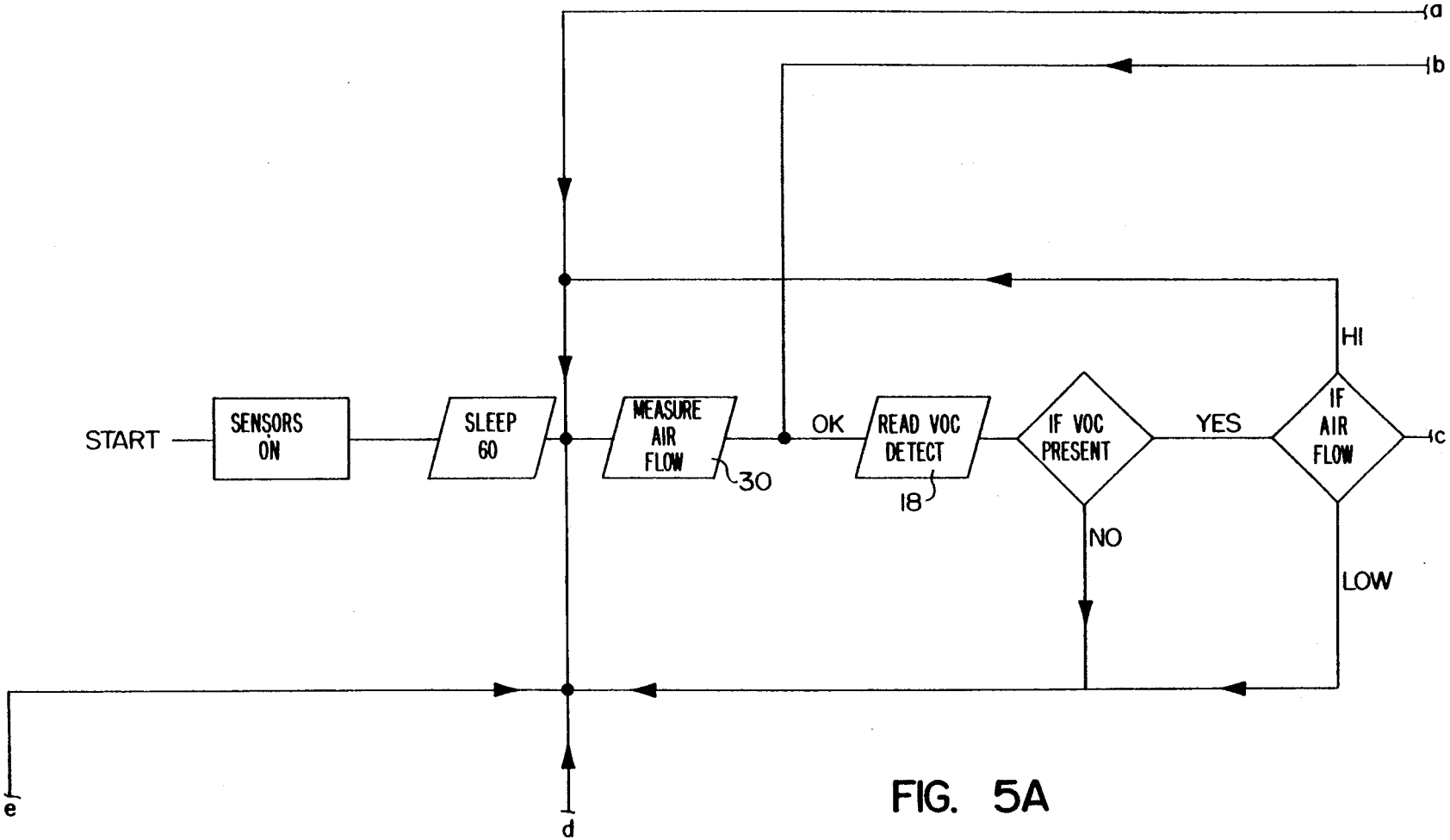
FIG. 5A-5D are logic diagrams of the present invention.
Figure 5B:
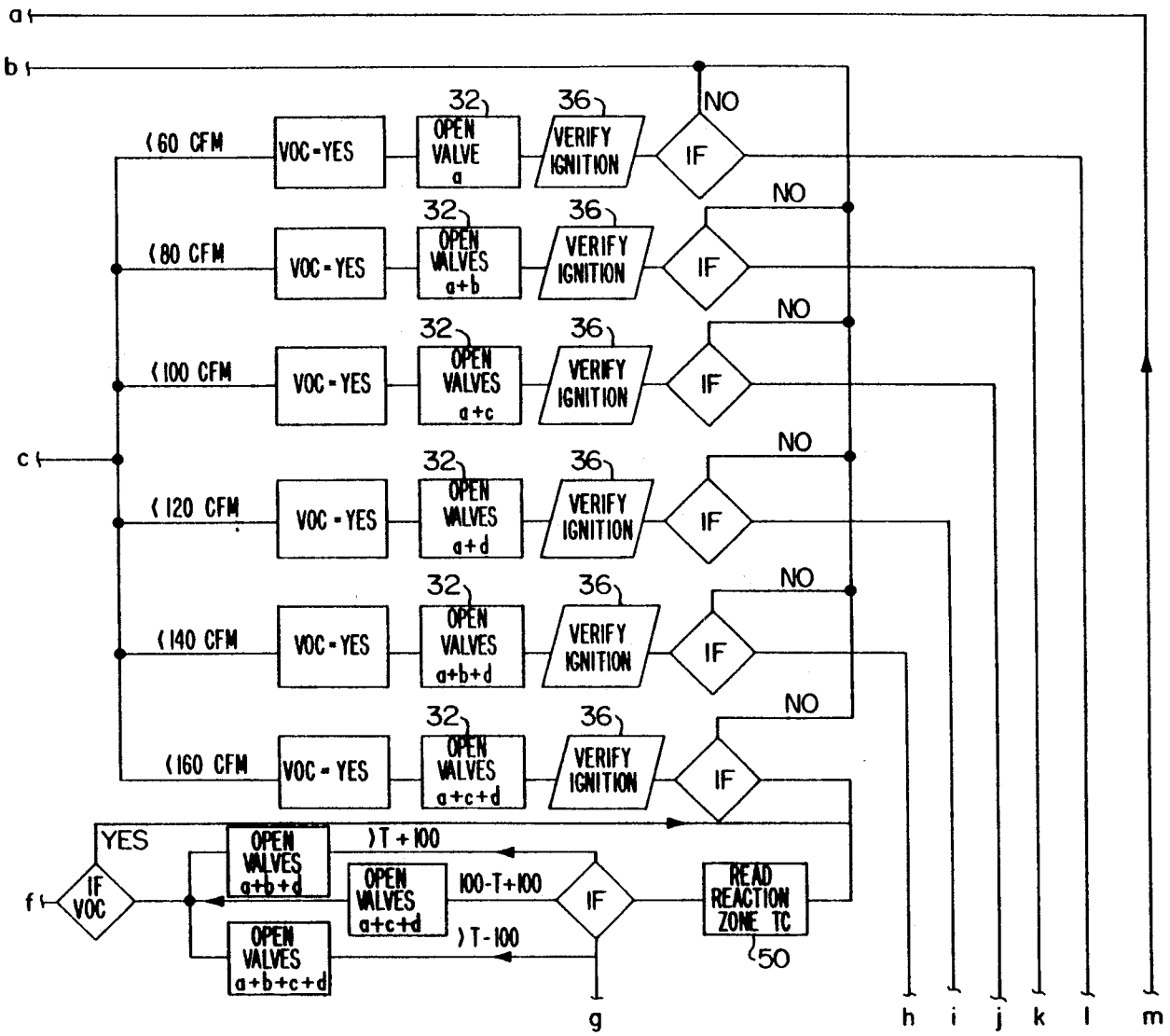
Figure 5C:
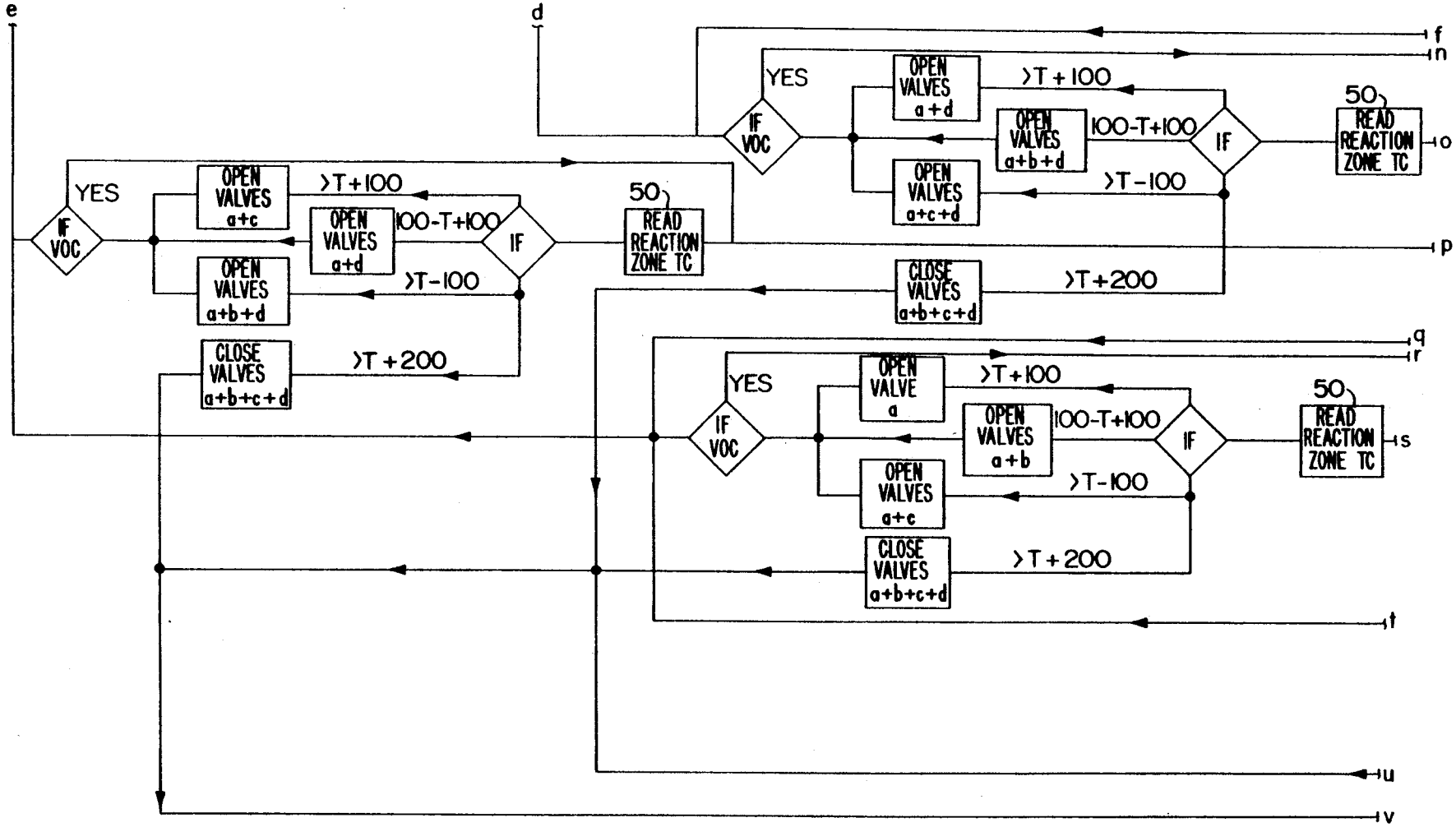
Figure 5D:
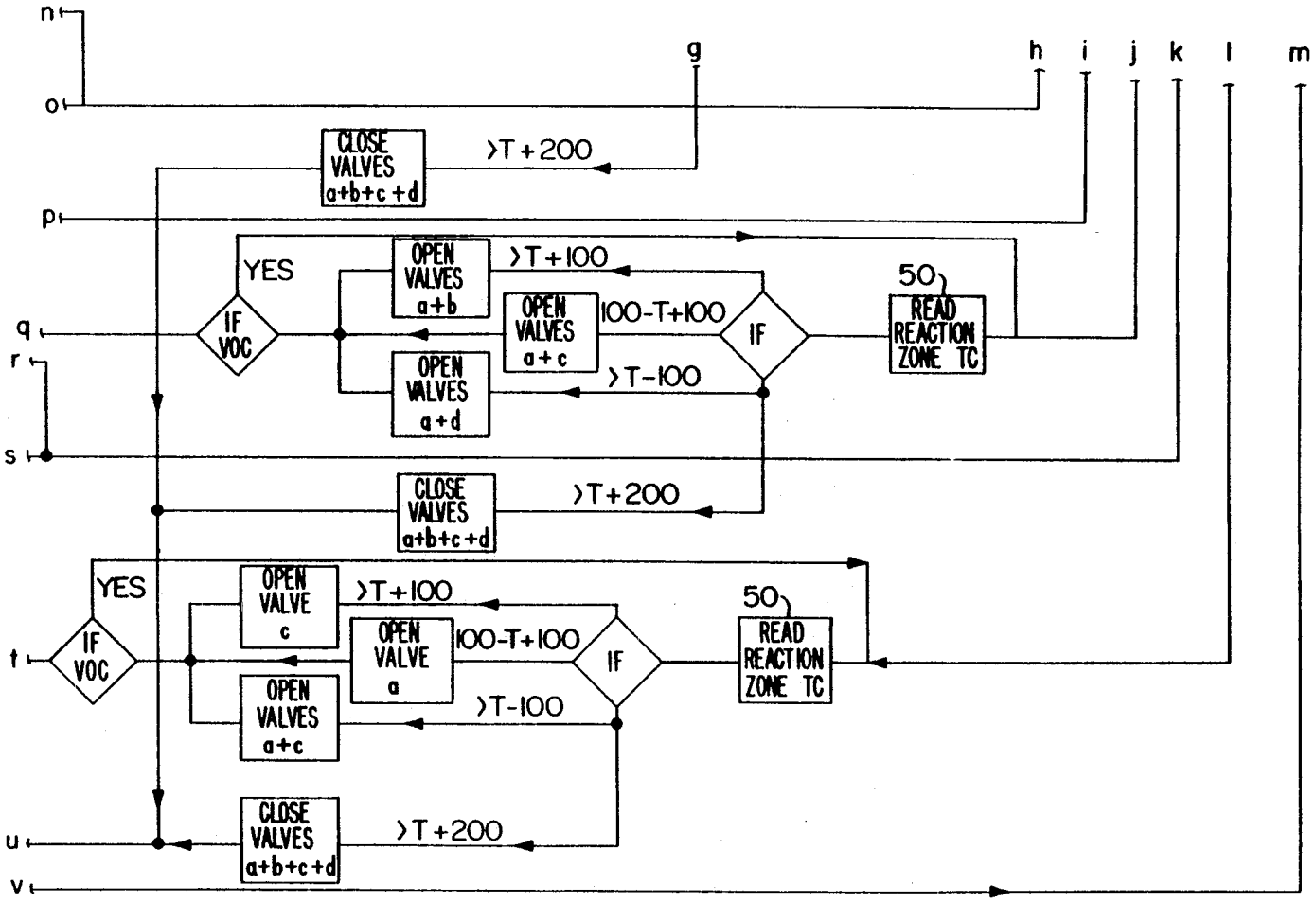

The device 200 depicted in FIG. 6 differs from the device 10 depicted in FIG. 2 through the addition of a flame baffle 210 that is mounted upon a first end 212 of an L-shaped rod 214. The other end 216 of the rod 214 is mounted to the wall of the intake end 14 of the device. The flame baffle 210 is positioned within the combustion zone 38 of the combustion chamber 80 and serves to create a mixing and vortexing of the expanding hot air plus VOC mixture. The baffle 210 thus serves to increase the efficiency of the VOC incineration by furthering the mixing of VOC's with hot air in the combustion zone 38. The thermocouple 50 is placed immediately below the disc 211 to measure the combustion zone temperature.

Figure 7:
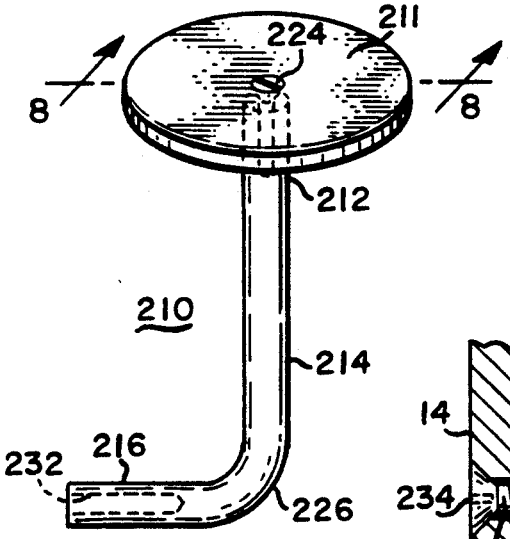
FIG. 7 is a perspective view of the flame baffle depicted in FIG. 6.
Figure 8:
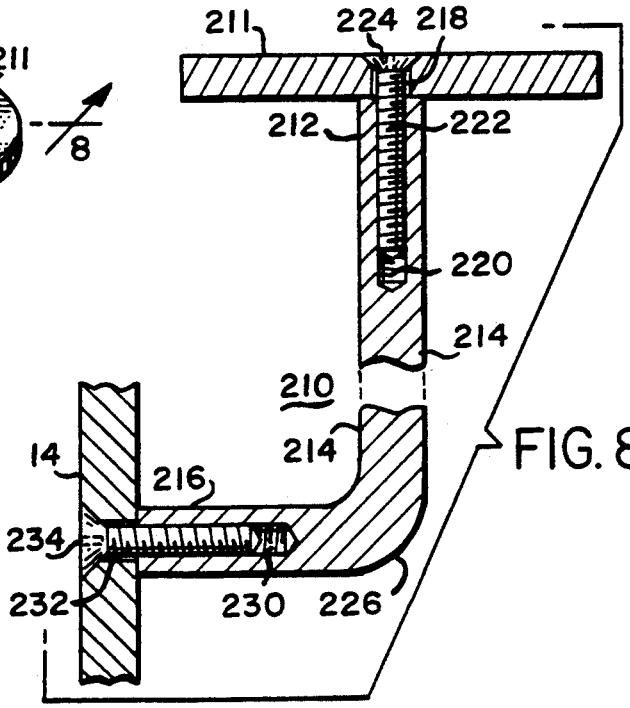
FIG. 8 is an enlarged cross-sectional view of the flame baffle depicted in FIGS. 6 and 7, taken along lines 8—8 of FIG. 7.

The detailed construction of the baffle 210 and rod 214 is shown in FIGS. 7 and 8, wherein FIG. 7 is a perspective view of the baffle 210 and FIG. 8 is a cross-sectional view taken along lines 8—8 of FIG. 7. As depicted in FIGS. 7 and 8, the flame baffle 210 is a flat circular disc 211 having a centrally disposed bore 218 formed therethrough. The first end 212 of the rod 214 has a threaded, axially disposed bore 220 formed therein, and a threaded screw 222 passes through the bore 218 in threaded engagement in the bore 220, such that the head 224 of the screw 222 holds the disc 211 in a tight engagement with the end 212 of the rod 214. It is within the contemplation of the present invention that other means of attaching the disc 211 to the end 212 of the rod 214 can be implemented.

In the preferred embodiment, the rod 214 is formed with a right angle bend 226, such that the lower end 216 of the rod 214 is engaged to the wall 14 of the intake end of the device. To achieve the engagement, a threaded, axially disposed bore 230 is formed in the end 216. A hole 232 is formed through the wall 14 in axial alignment with the bore 230, and a threaded screw 234 passes through the hole 232 in threaded engagement within the threaded bore 230. It is within the contemplation of the present invention that other means of attaching the end 216 to the wall 14 can be implemented. In the preferred embodiment, the diameter of the disc 211 is approximately ½ to ¾ of the diameter of the intake opening 240 of the combustion chamber. The disc 211 is positioned within the combustion chamber 40 at a distance d in front of the intake orifice 240 that is approximately ¼ of the diameter of the intake orifice 240. Thus, in the preferred embodiment for an 8 inch diameter exhaust pipe 14, having an 8 inch diameter intake orifice 240, a disc 211 having a diameter of 6 inches that is positioned a distance d of 2 inches from the orifice 240 will produce significantly increased efficiency in the incineration of VOC's accompanied by significantly reduced fuel consumption. Specifically, test results have shown that destruction of greater than 95% of VOC's is typically obtained using a quantity of fuel that is less than the LFL of the air plus VOC mixture.

Figure 9:
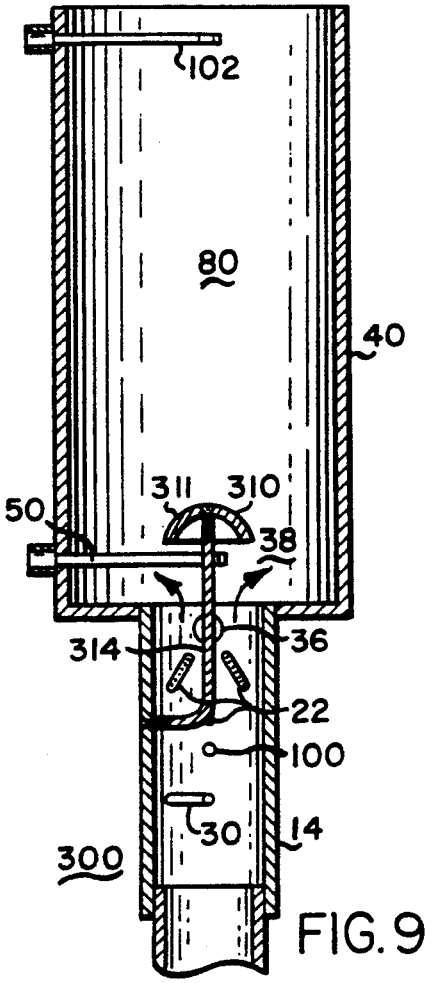
FIG. 9 is a cross-sectional view of the combustion chamber of the present invention as shown in FIG. 6, depicting an alternative embodiment of a flame baffle in a cross-sectional view that is similar to FIG. 6.
Figure 10:
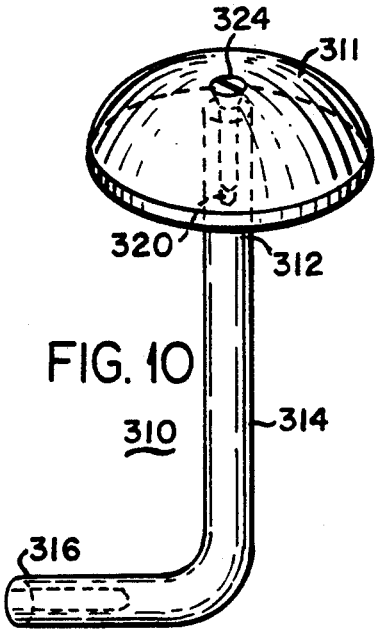
FIG. 10 is a perspective view of the flame baffle depicted in FIG. 9.

FIGS. 9 and 10 depict an alternative embodiment 300 of the present invention, wherein a flame baffle 310 is disposed proximate the combustion zone 38 of the combustion chamber 40. FIG. 9 is a cross-sectional view of the combustion chamber of the present invention, and FIG. 10 is a perspective view of the flame baffle 310. The significant difference between the flame baffle 310 and the previously described flame baffle 210 is that the flame baffle 310 is formed in a curved or domed shape baffle member 311 rather than the flat shape of disc 211. In the preferred embodiment, the baffle member 311 is approximately 6 inches in diameter and is 2 inches deep. The baffle member 311 is engaged to the upper end 312 of an L-shaped rod 314 utilizing a threaded screw 324 which is engaged in a threaded bore 320 in a similar manner to the engagement of disc 211. The lower end 316 of the rod 314 is engaged to the wall 14 of the device 10 in a similar manner to that of baffle 210. The domed shape of the baffle member 311 provides improved mixing and vortexing of the hot air and VOC mixture, which contributes to the efficiency of the device and lowers the fuel consumption rate.

Figure 12:
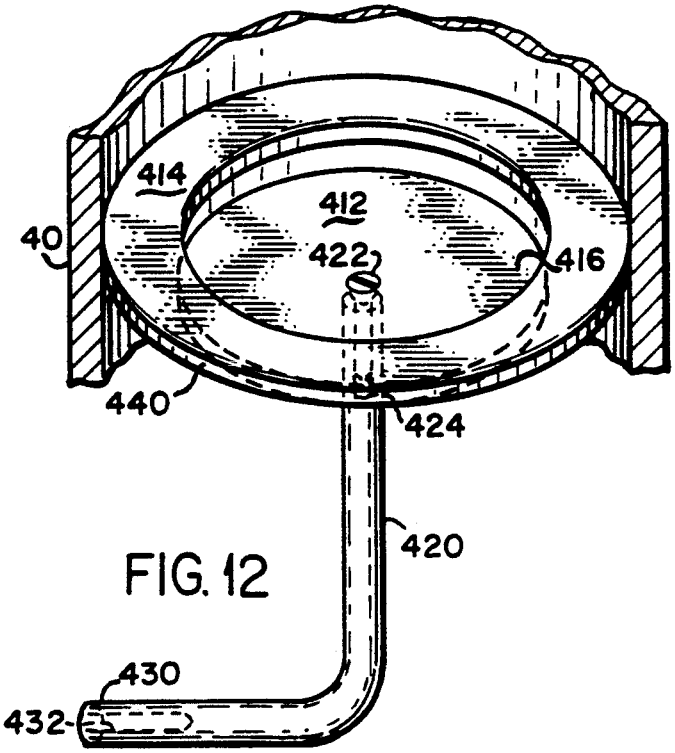
FIG. 12 is a perspective view of the flame baffle depicted in FIG. 11.
Figure 11:
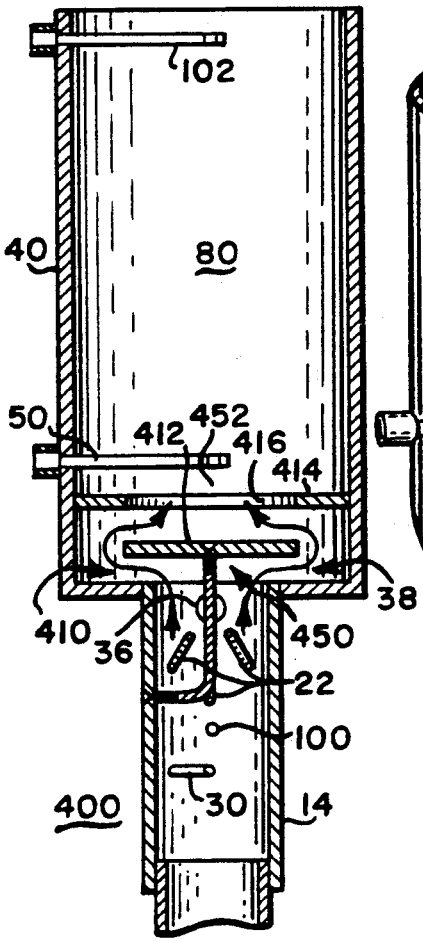
FIG. 11 is a cross-sectional view of the combustion chamber of the present invention as shown in FIG. 6, depicting another preferred embodiment of a flame baffle.

FIGS. 11 and 12 depict another device 400 having an alternative flame baffle means 410 disposed within the combustion zone 38 of the combustion chamber 40. FIG. 11 is a cross-sectional view of the combustion chamber of the present invention, and FIG. 12 is a perspective view of the flame baffle 410. The flame baffle 410 includes two components, a first, solid disc shaped baffle member 412 which is similar to baffle 210, and a second larger, circular disc 414 having a large orifice 416 centrally disposed therethrough. In like manner to the engagement of disc 211, the disc 412 is mounted to an L-shaped rod 420 utilizing a mounting screw 422 that is threadably engaged in a bore 424 formed in a first end of the rod 420; the lower end 430 of the rod 420 is engaged to the wall 14 of the intake end of the device 400 utilizing a threaded screw that mates with a threaded bore 432 formed in the end 430.

The second disc 414 is engaged at its outer circumference 440 to the inner surface of the chamber wall 40 by welding, bolting or similar means that can withstand the high temperatures of the combustion zone of the device. As indicated hereinabove, a relatively large orifice 416 is centrally located through the second disc 414. As is best see with the aid of FIG. 11, disc 412 is disposed proximate the intake end 450 of the combustion zone 38, and the disc 414 is disposed at the upper portions 452 of the combustion zone 38. The positioning of the two discs 412 and 414 serves to create a convoluted path through which the incinerated VOC plus hot air mixture must pass, whereby significantly increased mixing and vortexing of the VOC's with the hot air occurs. In the preferred embodiment the diameter of the orifice 416 is approximately ¾ths of the diameter of disc 414, and the diameter of disc 412 is approximately 5/4ths of the diameter of orifice 416. The device 400 thus results in improved efficiency and decreased fuel requirements. It is to be noted that the combustion zone temperature sensor 50 has been relocated in device 400 to the outer end of the orifice 416, such that it properly senses the combustion zone temperature after the full mixing and incineration of VOC's has occurred.

While three preferred flame baffle embodiments 210, 310 and 410 have been described, it is within the contemplation of the invention that further and other types of flame baffles could be positioned within the combustion zone to aid in the mixing and thus conversion of the VOC's within the hot air. Thus, the applicant's improvement herein is not to be limited to the specific embodiments shown; but rather, is meant to include all such devices as would be seen to be equivalent structures to one skilled in the art upon review of this disclosure.

Figure 13:
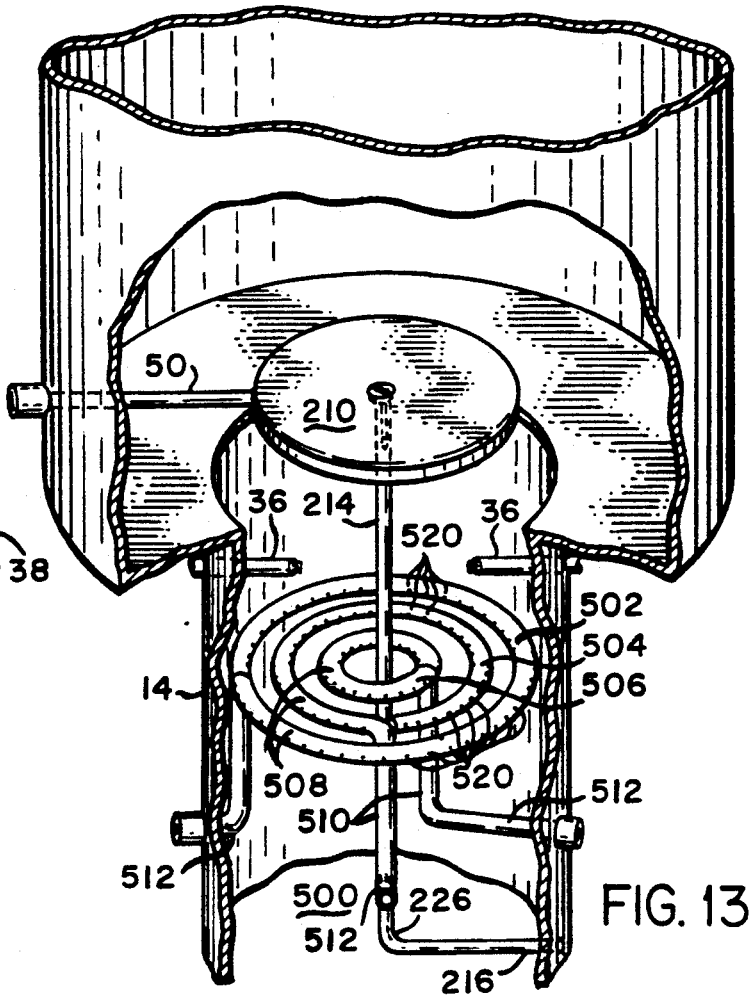
FIG. 13 is a perspective view of an improved fuel injector that is shown with a baffle such as that depicted in FIGS. 6, 7 and 8.

FIG. 13 is a perspective view of an improved fuel injection system shown disposed in a cutaway portion of the intake 14 of the present invention. A flame baffle 210 that is similar to the baffle depicted in FIGS. 6, 7 and 8, discussed hereinabove, is included therewith. The fuel injector 500 includes three concentrically disposed, ring-shaped fuel injection rods 502, 504 and 506. Each of the fuel injection rods 502, 504 and 506 is formed with an upper ring-shaped portion 508 having an end portion that is bent downwardly in a straight section 510 which is then bent in an outwardly projecting section 512 to penetrate the wall of the intake end 14 and engage the fuel injection line 34 of the device 10. A plurality of fuel injection orifices 520 are formed in the sides of each of the ring-shaped portions 508 of the fuel injectors 502, 504 and 506. In the preferred embodiment, the injection orifices 520 are formed laterally through both the outer side wall and inner side wall of each ring-shaped portion 508. The fuel injection orifices are preferably approximately 0.06 inches in diameter and are spaced approximately ½ of an inch apart. It is the purpose of the fuel injector 500 to disperse the fuel into the incoming air plus VOC mixture as uniformly and rapidly as possible, such that the VOC's in the incoming air will be exposed to the high temperature of the burning fuel and cold spots will be substantially eliminated. To provide redundancy, two fuel ignitors 36 ar provided to ignite the fuel plus air mixture.

The utilization of the baffle 210 together with the fuel ignition system 50 results in improved performance in both VOC consumption and fuel efficiency. This preferred embodiment requires only enough fuel to reach approximately ½ of the lower flammable limit (LFL) of the fuel and air plus VOC mixture. This is because when the fuel is first introduced into the moving airstream, prior to its uniform mixing therewith, the fuel is in sufficient concentration in localized areas proximate the fuel injection orifices 520 to be above the lower flammable limit, whereupon these enriched portions of the fuel and VOC plus air mixture will ignite. The large number of fuel injection orifices 520 in the fuel injection system 500 thus creates a large number of ignited, fuel rich areas which serve to sufficiently heat the entire incoming airstream. The baffle 210 further serves to mix the hot incinerated portions with the remainder of the airstream, resulting in a greater than 95% incineration of the VOC's within the incoming airstream.

In operating the preferred embodiment which utilizes the fuel injector 500 together with a baffle system such as baffle 210, the four needle valves 31(*a–d*) described hereinabove, may be set to lower fuel injection rates than are above indicated. Specifically, because this preferred embodiment operates utilizing only enough fuel to reach approximately ½ of the lower flammable limit, the fuel gas flow rate of the needle valves 31(*a–d*) may be set to ½ of the values indicated above. That is, the needle valves are set to provide fuel gas flow rates of 31*a* at 1 ½ CFM, 31*b* at ½ CFM, 31*c* at 1 CFM, and 31*d* at 1 ½ CFM. The solenoid valve combinations discussed hereinabove remain accurate for the air flow volumes described above.

While the invention has been particularly shown and described with reference to certain preferred embodiments, it will be understood by those skilled in the art that various alterations and modifications in form and in detail may be made therein. Accordingly, it is intended that the following claims cover all such alterations and modifications as may fall within the true spirit and scope of the invention.

What is claimed is:

1. A volatile organic compound (VOC) incinerator comprising:

an incineration chamber having an intake end and an exhaust end and a combustion chamber disposed therebetween;

said intake end being pneumatically engaged to a device that generates a VOC plus air mixture, and said exhaust end being pneumatically connected to an air drawing device, whereby said VOC plus air mixture is drawn through said combustion chamber;

a fuel injection means being disposed proximate said intake end and functioning to inject fuel into said VOC plus air mixture;

a fuel control means being engaged to said fuel injection means and operable to control the quantity of fuel supplied to said fuel injection means;

an ignition means being disposed proximate said fuel injection means and operable to ignite said fuel for burning within a combustion zone within said combustion chamber;

a baffle means being disposed within said combustion zone to cause increased mixing of said VOC's with said air within said combustion zone;

a temperature sensing means being disposed in said combustion zone and operative to generate temperature signals representative of the temperature of said burning fuel within said combustion zone;

an air flow rate detector means being disposed in said intake end to measure the flow rate of said VOC plus air mixture through said intake end and to provide air flow rate signals representative thereof;

a controller means having predetermined temperature control parameters installed therewithin and being operative to receive said temperature signals from said temperature sensing means and to generate control signals in response to said temperature signals that are transmitted to said fuel control means, such that said fuel control means is controlled by said control signals from said controller means;

said controller means having predetermined air flow rate parameters installed therewithin and being operative to receive said air flow rate signals and to generate said control signals in response thereto;

whereby the quantity of fuel injected into said VOC plus air mixture is controlled by the temperature of the burning fuel within the combustion zone, and whereby the quantity of fuel injected into said VOC plus air mixture is also controlled by the air flow rate of the VOC plus air mixture passing through said intake end.

2. A volatile organic compound (VOC) incinerator as described in claim 1, further including:

a VOC detection means being disposed in said intake end and functioning to detect the presence of VOC's in said VOC plus air mixture, and to provide a VOC signal representative of the presence thereof to said controller means;

said controller means acting upon said VOC signal from said VOC detection means to control the activation of said fuel injection means.

3. A volatile organic compound (VOC) incinerator as described in claim 1 wherein said fuel injection means includes a plurality of concentrically disposed, ring-shaped fuel injection rods, each said rod being porous relative to said fuel, whereby said fuel may pass therethrough for mixing with said VOC plus air mixture.

4. A volatile organic compound (VOC) incinerator as described in claim 1 wherein said baffle means includes at least one baffle member being disposed within the flow stream of said VOC plus air mixture within said combustion zone, whereby increased mixing of said VOC's with said air is accomplished.

5. A volatile organic compound (VOC) incinerator as described in claim 4 wherein said baffle member is shaped as a flat, circular disc.

6. A volatile organic compound (VOC) incinerator as described in claim 5 wherein the diameter of said disc is approximately ½ to ¾ of the diameter of said intake end of said combustion chamber.

7. A volatile organic compound (VOC) incinerator as described in claim 4 wherein said baffle member is formed as a dome shaped member.

8. A volatile organic compound (VOC) incinerator as described in claim 7 wherein the diameter of said baffle is approximately ½ to ¾ of the diameter of said intake end of said combustion chamber.

9. A volatile organic compound (VOC) incinerator as described in claim 4 wherein said baffle member includes two circular, disc-shaped members, a first of said two disc-shaped members being a flat, solid circular disc that is disposed proximate said intake end of said combustion chamber, and the second of said two disc-shaped members being a circular disc having a relatively large orifice that is centrally disposed therethrough.

10. A volatile organic compound (VOC) incinerator as described in claim 9 wherein the diameter of said first disc is approximately ¾ of the diameter of said intake end of said combustion chamber and the diameter of said orifice is approximately ¾ of the diameter of said intake end.

11. A volatile organic compound (VOC) incinerator comprising:

an incineration chamber having an intake end and an exhaust end and a combustion chamber disposed therebetween;

said intake end being pneumatically engaged to a device that generates a VOC plus air mixture, and said exhaust end being pneumatically connected to an air drawing device, whereby said VOC plus air mixture is drawn through said combustion chamber;

a fuel injection means including a plurality of concentrically disposed ring-shaped fuel injection rods being disposed proximate said intake end and functioning to inject fuel into said VOC plus air mixture;

a fuel control means being engaged to said fuel injection means and operable to control the quantity of fuel supplied to said fuel injection means;

an ignition means being disposed proximate said fuel injection means and operable to ignite said fuel for burning within a combustion zone within said combustion chamber;

a baffle means being disposed within said combustion zone to cause increased mixing of said VOC's with said air within said combustion zone;

a temperature sensing means being disposed in said combustion zone and operative to generate temperature signals representative of the temperature of said burning fuel within said combustion zone;

an air flow rate detector means being disposed in said intake end to measure the flow rate of said VOC plus air mixture through said intake end and to provide air flow rate signals representative thereof;

a controller means having predetermined temperature control parameters installed therewithin and predetermined air flow rate parameters installed therewithin, said controller means being operative to receive said temperature signals and said air flow rate signals and to generate control signals related to both said temperature signals and said air flow rate signals; said control signals being transmitted to said fuel control means, such that said fuel control means is controlled by said control signals from said controller means;

whereby the quantity of fuel that is initially injected into said VOC plus air mixture is controlled by the air flow rate of the VOC plus air mixture passing through said intake end; and whereby the quantity of fuel that is subsequently injected into said VOC plus air mixture is controlled by the temperature of the burning fuel within the combustion zone.

12. A volatile organic compound (VOC) incinerator as described in claim 1 further including a VOC detection means being disposed in said intake end and functioning to detect the presence of VOC's in said VOC plus air mixture, and to provide a VOC signal representative of the presence thereof to said controller means;

said controller means acting upon said VOC signal from said VOC detection means to control the activation of said fuel injection means.

13. A volatile organic compound (VOC) incinerator as described in claim 11 wherein said baffle means includes at least one baffle member being disposed within the flow stream of said VOC plus air mixture within said combustion zone, whereby increased mixing of said VOC's with said air is accomplished.

14. A volatile organic compound (VOC) incinerator as described in claim 13 wherein said baffle member is shaped as a flat, circular disc.

15. A volatile organic compound (VOC) incinerator as described in claim 13 wherein the diameter of said disc is approximately ½ to ¾ of the diameter of said intake end of said combustion chamber.

16. A volatile organic compound (VOC) incinerator as described in claim 15 wherein said baffle member is formed as a dome shaped member.

17. A volatile organic compound (VOC) incinerator as described in claim 13 wherein the diameter of said baffle is approximately ½ to ¾ of the diameter of said intake end of said combustion chamber.

18. A volatile organic compound (VOC) incinerator as described in claim 17 wherein said baffle member includes two circular, disc-shaped members, a first of said two disc-shaped members being a flat, solid circular disc that is disposed proximate said intake end of said combustion chamber, and the second of said two disc-shaped members being a circular disc having a relatively large orifice that is centrally disposed therethrough.

19. A volatile organic compound (VOC) incinerator as described in claim 18 wherein the diameter of said first disc is approximately ¾ of the diameter of said intake end of said combustion chamber, and the diameter of said orifice is approximately ¾ of the diameter of said intake end.

20. A volatile organic compound (VOC) incinerator comprising:

an incineration chamber having an intake end and an exhaust end and a combustion chamber disposed therebetween;

said intake end being pneumatically engaged to a device that generates a VOC plus air mixture, and said exhaust end being pneumatically connected to an air drawing device, whereby said VOC plus air mixture is drawn through said combustion chamber;

a fuel injection means being disposed proximate said intake end and functioning to inject fuel into said VOC plus air mixture;

a fuel control means being engaged to said fuel injection means and operable to control the quantity of fuel supplied to said fuel injection means;

an ignition means being disposed proximate said fuel injection means and operable to ignite said fuel for burning within a combustion zone within said combustion chamber;

a temperature sensing means being disposed in said combustion zone and operative to generate temperature signals representative of the temperature of said burning fuel within said combustion zone;

an air flow rate detector means being disposed in said intake end to measure the flow rate of said VOC plus air mixture through said intake end and to provide air flow rate signals representative thereof;

a controller means having predetermined temperature control parameters installed therewithin and being operative to receive said temperature signals from said temperature sensing means and to generate control signals in response to said temperature signals that are transmitted to said fuel control means, such that said fuel control means is controlled by said control signals from said controller means;

said controller means having predetermined air flow rate parameters installed therewithin and being operative to receive said air flow rate signals and to generate said control signals in response thereto;

whereby the quantity of fuel injected into said VOC plus air mixture is controlled by the temperature of the burning fuel within the combustion zone, and whereby the quantity of fuel injected into said VOC plus air mixture is also controlled by the air flow rate of the VOC plus air mixture passing through said intake end.

21. A volatile organic compound (VOC) incinerator as described in claim 20, further including:

a VOC detection means being disposed in said intake end and functioning to detect the presence of VOC's in said VOC plus air mixture, and to provide a VOC signal representative of the presence thereof to said controller means;

said controller means acting upon said VOC signal from said VOC detection means to control the activation of said fuel injection means.

22. A volatile organic compound (VOC) incinerator as described in claim 20 wherein said fuel injection means includes a plurality of cylindrical fuel injection rods, each said rod being porous relative to said fuel, whereby said fuel may pass therethrough for mixing with said VOC plus air mixture.

23. A volatile organic compound (VOC) incinerator comprising:

an incineration chamber having an intake end and an exhaust end and a combustion chamber disposed therebetween;

said intake end being pneumatically engaged to a device that generates a VOC plus air mixture, and said exhaust end being pneumatically connected to an air drawing device, whereby said VOC plus air mixture is drawn through said combustion chamber;

a fuel injection means being disposed proximate said intake end and functioning to inject fuel into said VOC plus air mixture;

a fuel control means being engaged to said fuel injection means and operable to control the quantity of fuel supplied to said fuel injection means;

an ignition means being disposed proximate said fuel injection means and operable to ignite said fuel for burning within a combustion zone within said combustion chamber;

a temperature sensing means being disposed in said combustion zone and operative to generate temperature signals representative of the temperature of said burning fuel within said combustion zone;

an air flow rate detector means being disposed in said intake end to measure the flow rate of said VOC plus air mixture through said intake end and to provide air flow rate signals representative thereof;

a controller means having predetermined temperature control parameters installed therewithin and predetermined air flow rate parameters installed therewithin, said controller means being operative to receive said temperature signals and said air flow rate signals and to generate control signals related to both said temperature signals and said air flow rate signals; said control signals being transmitted to said fuel control means, such that said fuel control means is controlled by said control signals from said controller means;

whereby the quantity of fuel that is initially injected into said VOC plus air mixture is controlled by the air flow rate of the VOC plus air mixture passing through said intake end; and whereby the quantity of fuel that is subsequently injected into said VOC plus air mixture is controlled by the temperature of the burning fuel within the combustion zone.

24. A volatile organic compound (VOC) incinerator as described in claim 23 further including a VOC detection means being disposed in said intake end and functioning to detect the presence of VOC's in said VOC plus air mixture, and to provide a VOC signal representative of the presence thereof to said controller means;

said controller means acting upon said VOC signal from said VOC detection means to control the activation of said fuel injection means.

* * * * *